US006845639B1

(12) United States Patent
Hajek

(10) Patent No.: US 6,845,639 B1
(45) Date of Patent: Jan. 25, 2005

(54) STRETCHABLE LOOP-TYPE WARP KNITTED TEXTILE FASTENER FABRIC AND METHOD OF PRODUCING SAME

(75) Inventor: Peter Hajek, Burlington, NC (US)

(73) Assignee: GFD Fabrics, Inc., Greensboro, NC (US)

( * ) Notice: Subject to any disclaimer, the term of this patent is extended or adjusted under 35 U.S.C. 154(b) by 0 days.

(21) Appl. No.: 10/114,640

(22) Filed: Apr. 2, 2002

(51) Int. Cl.[7] ..... D04B 21/18
(52) U.S. Cl. ..... 66/195
(58) Field of Search ..... 66/191, 192, 193, 66/194, 195; 442/312

(56) References Cited

U.S. PATENT DOCUMENTS

| | | | | | |
|---|---|---|---|---|---|
| 3,308,827 | A | | 3/1967 | Gross | 128/290 |
| 4,067,209 | A | | 1/1978 | Kucera et al. | 66/195 |
| 4,297,858 | A | | 11/1981 | Blasberg et al. | 66/194 |
| 5,214,942 | A | | 6/1993 | Peake, III et al. | 66/194 |
| 5,512,354 | A | | 4/1996 | Scholz et al. | 428/231 |
| 5,520,022 | A | | 5/1996 | Callaway | 66/194 |
| 5,557,950 | A | * | 9/1996 | Richards et al. | 66/194 |
| 5,596,888 | A | | 1/1997 | McLarty, III et al. | 66/195 |
| 5,802,883 | A | | 9/1998 | Matsuda et al. | 66/193 |
| 5,916,273 | A | * | 6/1999 | Hepfinger | 66/194 |
| 6,076,377 | A | | 6/2000 | Ta-An | 66/195 |
| 6,096,667 | A | * | 8/2000 | Rhode | 442/313 |
| 6,099,932 | A | * | 8/2000 | Gehring | 428/91 |
| 6,196,031 | B1 | * | 3/2001 | Ducauchuis | 66/192 |
| 6,216,496 | B1 | | 4/2001 | Gehring | 66/191 |
| 6,282,926 | B1 | | 9/2001 | Matsuda et al. | 66/192 |
| 6,305,196 | B1 | | 10/2001 | Takeshita et al. | 66/195 |

FOREIGN PATENT DOCUMENTS

| | | |
|---|---|---|
| EP | 0 223 075 A1 | 5/1987 |
| EP | 0 517 275 A2 | 12/1992 |
| GB | 1 557 328 | 12/1979 |

* cited by examiner

*Primary Examiner*—Danny Worrell
(74) *Attorney, Agent, or Firm*—Kennedy Covington Lobdell & Hickman, LLP

(57) ABSTRACT

A warp knitted textile fabric and a method of producing such a fabric, characterized by a resiliently stretchable three-bar stitch construction, one fabric surface of which presents outwardly extending knitted loops adapted to serve as the loop component in a hook-and-loop fastener system. The fabric is knitted on a warp knitting machine by interknitting ground, elastic and loop-forming yarns together in knitted stitches on spaced needles in spaced fabric courses and interknitting stitches of the ground and elastic yarns on the same spaced needles in intervening courses while forming loops of the loop-forning yarns on inactive intervening needles to be cast off without integration into the ground structure of the fabric so as to form outwardly extending pile loops on one fabric surface. The pile loops do not require brushing or napping to render the fabric suitable for use in a hook-and-loop fastener system.

27 Claims, 2 Drawing Sheets

STRETCHABLE LOOP-TYPE WARP KNITTED TEXTILE FASTENER FABRIC AND METHOD OF PRODUCING SAME

BACKGROUND OF THE INVENTION

The present invention relates generally to warp knitted textile fabrics and methods of producing such fabrics. More particularly, the present invention relates to a novel warp knitted loop-type textile fabric adapted for use as the loop component in a hook-and-loop type two-component fabric fastener, and a method by which such a fastener fabric may be produced on a warp knitting machine.

So called hook-and-loop fasteners have gained considerable popularity over recent years. Such fasteners basically include two generally flat components attachable and detachable to and from face abutting relation with one another. Typically, each fastener component is of a textile fabric construction, the hook or "male" component having a fabric ground layer with a plurality of relatively stiff hook-shaped or barb-like elements extending in upstanding relation from one face of the ground layer, and the loop or "female" component similarly having a fabric ground layer with a plurality of relatively flexible pile-type loops extending outwardly from one face of the ground layer. In use, the hook and loop faces of the fastener components grippingly engage one another when pressed together in face abutting relation by penetration of the hook-shaped elements of the hook component into the loops at the opposing face of the loop component. The engagement between the hook and loop faces of the two components resists separation thereof until a threshold force is exerted on one component in a peeling-like fashion.

In the past, it has been typical to fabricate both textile fabric components of conventional hook-and-loop fasteners of relatively heavyweight, stiff or otherwise dimensionally stable constructions, for various purposes including, among other things, withstanding repeated attachments and detachments so as to achieve a prolonged life of the fastener. Until recently, the components of such fastener fabrics have predominantly been produced in the form of a narrow-width tape of indeterminate length. However, as the potential uses and applications for hook-and-loop fasteners have grown and expanded, it has been proposed to produce one or both fastener components, often the loop component, in diverse other forms, e.g., of substantially greater width than the conventional tape-like form, and in less stiff and more pliable and drapable or formable textile fabric structures. For example, it has been recognized that some products which inherently must be elastically stretchable, e.g., athletic and medical wraps and bandaging, would benefit from the use of hook-and-loop fasteners. However, it is quite difficult to produce an elastically stretchable textile fabric in a loop-form suitable for use as the loop component of a hook-and-loop fastener. Like the majority of loop-type textile fastener fabrics, the raised loop character of stretchable forms of such fabrics is provided by napping one surface of a stretchable fabric, but disadvantageously it is difficult and expensive to perform a napping operation on a stretchable fabric and the results, particularly as to the uniformity of the loop height, are often inconsistent.

SUMMARY OF THE INVENTION

It is accordingly an object of the present invention to provide an elastically stretchable textile fabric of a warp knitted construction suitable for use in a hook-and-loop type two-component fabric fastener system. A more particular object of the present invention is to provide such a fabric which overcomes the disadvantages of known stretchable loop-type fabrics such as described above. Another object of the present invention is to provide such a loop-type warp knitted textile fastener fabric wherein the raised loops are produced in the knitting operation so as to eliminate any need for a subsequent napping operation. The present invention also seeks to provide a novel method by which such a textile fastener fabric may be produced.

Briefly summarized, the present invention addresses these objectives by providing a warp knitted textile fastener fabric of a three-bar stitch construction comprised of a set of ground yarns, a set of elastic yarns and a set of loop-forming yarns interknitted together in respective patterns of stitches formed in longitudinally extending wales and transversely extending courses. In accordance with the present invention, the ground yarns provide structural integrity to the fabric while permitting the elastic yarns to stretch and contract in at least one fabric direction. The loop-forming yarns form stitches interknitted with the ground and elastic yarns in only selected spaced courses, while forming outwardly extending knitted loops between such stitches, which loops are adapted for mated engagement with hooking elements of another fabric for use in a two-component fabric fastener of the hook-and-loop type.

According to the method of the present invention, such a warp knitted textile fabric fastener is produced on a warp knitting machine of the type basically having a needle bar equipped with a series of aligned knitting needles. The respective sets of ground yarns, elastic yarns and loop-forming yarns are interknitted on the warp knitting machine in their respective stitch patterns basically by forming spaced courses of the fabric by knitting stitches of the ground, elastic and loop-forming yarns together with one another on spaced needles of the needle bar and forming intervening courses of the fabric by knitting stitches of only the ground and elastic yarns on the spaced needles while forming loops of the loop-forming yarns on empty intervening needles of the needle bar which loops are then cast off from the intervening needles. In this manner, the ground and the elastic yarns are knitted in stitches in substantially each wale of substantially each course of the fabric to provide structural integrity to the fabric while permitting the elastic yarns to stretch in at least one fabric direction. The loop-forming yarns are knitted with the ground and elastic yarns in stitches in spaced courses to secure the loop-forming yarns in the fabric with the cast-off loops of the loop-forming yarns extending therebetween outwardly from the fabric to provide for mated engagement of the fabric with a hook-type fastener fabric component.

Various embodiments of the above-described textile fabric fastener and fabric-forming method are contemplated, including for example embodiments wherein the respective stitch patterns of the constituent yarns permit resilient stretchability of the fabric primarily only in the walewise direction, and other embodiments wherein the stitch patterns of the yarns permit resilient stretchability of the fabric in both walewise and coursewise directions. For example, the elastic yarns may be knitted in a chain stitch pattern in conjunction with insertion of the ground yarns in a coursewise inlaid pattern so as to restrict coursewise stretchability but provide largely unrestricted walewise stretchability. Alternatively, both the elastic and ground yarns may be knitted in respective stitch patterns wherein stitches of each such yam traverse in their own respective patterns coursewise between differing wales, which will enable resilient stretchability of the fabric in both walewise and coursewise directions. In most embodiments, it will be preferred that the loop-forming yarns be knitted with the ground and elastic yarns in stitches in every alternating wale of every alternating course, which optimizes the number and density of the available fastener loops. Various types and sizes of the constituent yarns may be utilized, but it will be preferred in almost every embodiment that the ground and loop-forming yarns be relatively inelastic. For example, a preferred form of ground yarns are textured synthetic filamentary yarns, which help contribute to the elasticity of the ground fabric structure. The loop-forming yarns are preferably untextured flat filamentary yarns.

By way of example but without limitation, one contemplated embodiment of the present fabric and method provides for the ground yarns to be inlaid in a 0-0, 5-5 pattern, while the elastic yarns are knitted in a 1-0, 0-1 chain stitch pattern, and the loop-forming yarns are knitted in a 4-3, 1-0 stitch pattern. An alternative embodiment provides for the ground yarns to be knitted in a 1-0, 4-5 stitch pattern. Each such embodiment provides for predominantly only walewise stretchability of the resultant fabric. An alternative embodiment of the present fabric and method which provides for both walewise and coursewise stretchability knits the ground yarns in a 4-5, 1-0 stitch pattern, the elastic yarns in a 1-0, 2-3 stitch pattern, and the loop-forming yarns in a 1-0, 4-3 stitch pattern. Of course, persons skilled in the relevant art will readily recognize and understand that numerous other stitch combinations may be utilized to selectively produce differing fabric properties, without departing from the substance and scope of the present invention.

These and other features, details and advantages of the present fabric and method will be described and understood from the following disclosure of several contemplated embodiments of the invention with reference to the accompanying drawings.

BRIEF DESCRIPTION TO THE DRAWINGS

Figure 1:
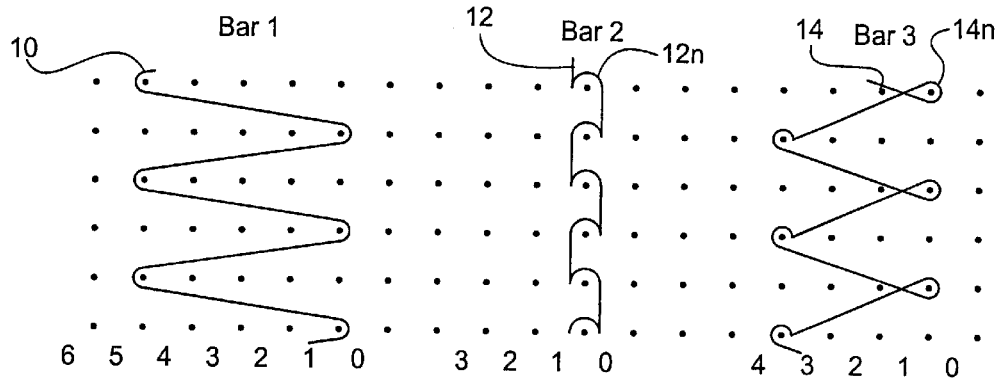
FIG. 1 is a diagram showing individually the stitch patterns for the ground, elastic and loop-forming yarns carried out by a warp knitting machine in knitting one preferred embodiment of the present fabric according to the method of the present invention.
Figure 3:
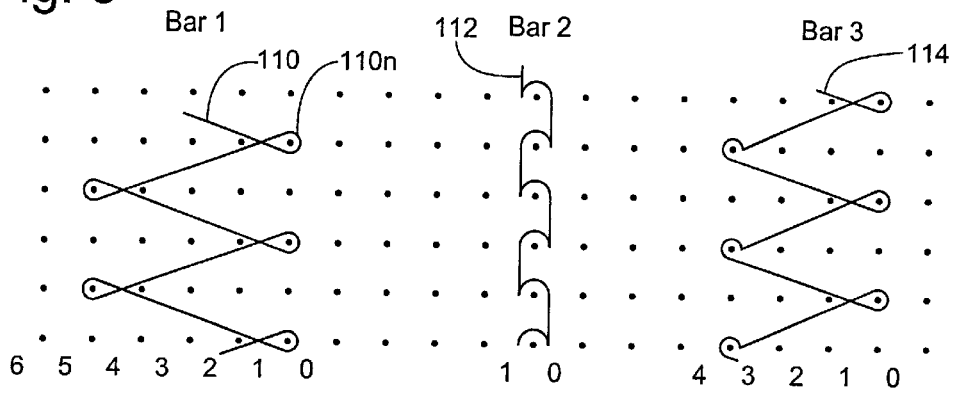
FIG. 3 is another diagram, similar to FIG. 1, showing individually the stitch patterns for the ground, elastic and loop-forming yarns carried out by a warp knitting machine in knitting a second preferred embodiment of the present fabric according to the method of the present invention.
Figure 5:
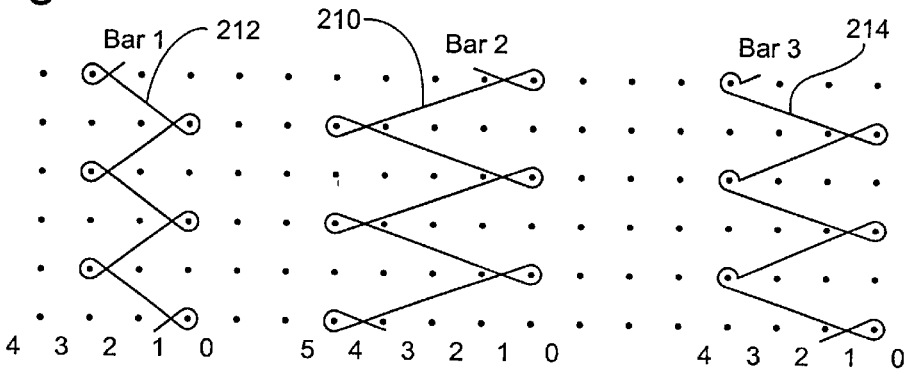
Figure 2:
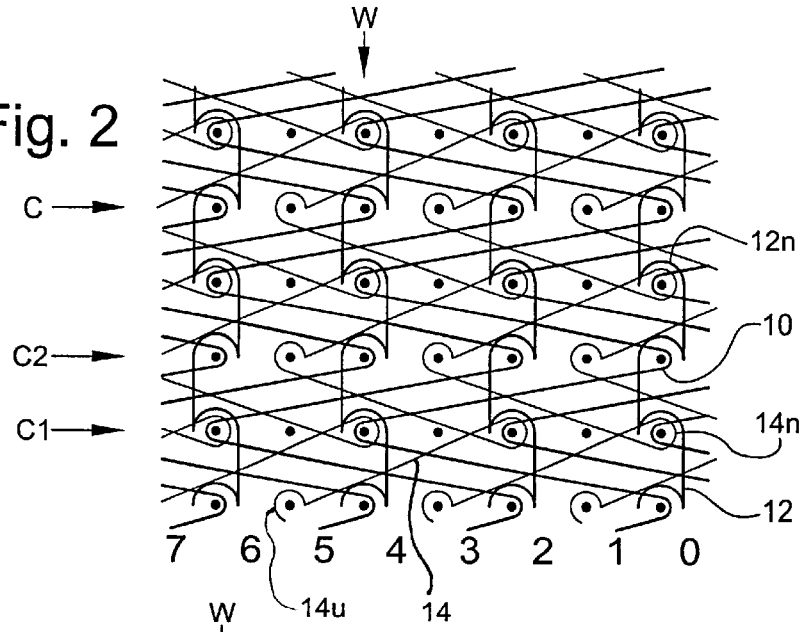
FIG. 2 is a composite diagram thereof, showing the inter-relationship of the ground, elastic and loop-forming yarns as integrated together in a finished fabric.
Figure 4:
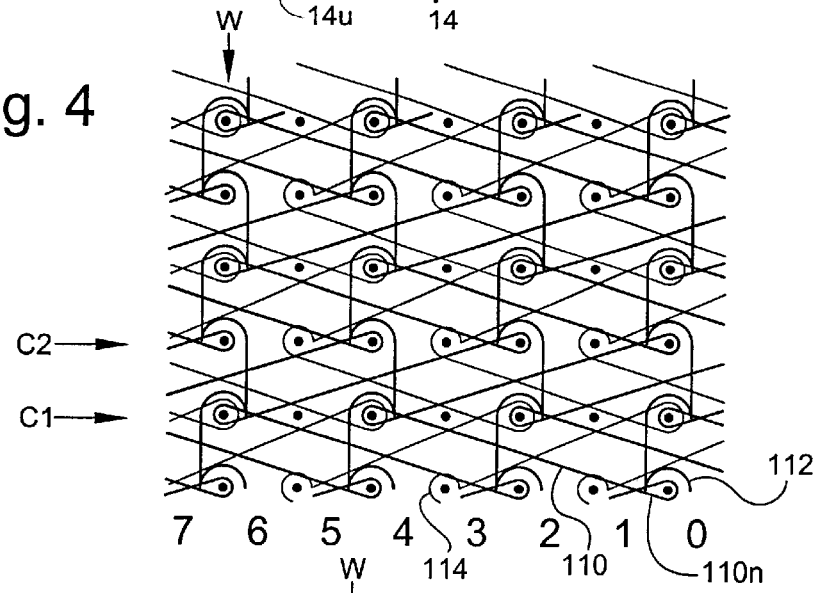
FIG. 4 is a composite diagram thereof, similar to FIG. 2, showing the interrelationship of the ground, elastic and loop-forming yarns as integrated together in a finished fabric.
Figure 6:
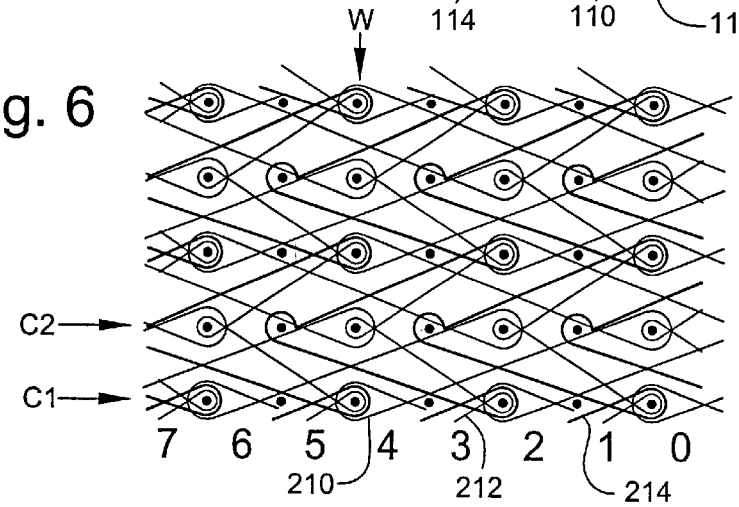

FIG. 5 is another diagram, similar to FIGS. 1 and 3, showing individually the stitch patterns for the ground, elastic and loop-forming yarns as carried out by a warp knitting machine in knitting a third preferred embodiment of the present fabric according to the method of the present invention; and FIG. 6 is a composite diagram thereof, similar to FIGS. 2 and 4, showing the inter-relationship of the ground, elastic and loop-forming yarns as integrated together in a finished fabric.

DETAILED DESCRIPTION OF THE PREFERRED EMBODIMENTS

As explained more fully herein, the preferred embodiments of the fabric of the present invention are produced, and the preferred embodiments of the method of the present invention are carried out, on a warp knitting machine which may be of substantially any conventional type of an at least three-bar construction having three or more yarn guide bars and a needle bar, e.g., a conventional tricot warp knitting machine. The construction and operation of such machines are well known in the warp knitting art and need not herein be specifically described and illustrated. In the following description, the yarn guide bars of the knitting machine are identified as "top," "middle" and "bottom" guide bars for reference purposes only and not by way of limitation. As those persons skilled in the art will understand, such terms equally identify knitting machines whose guide bars may be referred as "front," "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

Fundamentally, the novelty of the present invention is characterized by the warp knitting of ground and elastic yarns in any appropriately compatible stitch patterns which produce a ground fabric structure wherein the elastic yarns impart resilient stretchability to the fabric in at least the walewise direction of the fabric, i.e., the so-called machine direction of the fabric, while loop-forming yarns are knitted periodically on the same needles of the needle bar as the ground and elastic yarns so as to be integrated into the ground structure in only spaced courses with the loop-forming yarns being placed on inactive needles in the knitting of intervening courses so that the loops thereby formed are cast off the inactive needles without being incorporated into the ground structure of the fabric, whereby such loops of the loop-forming yarns extend outwardly from one surface of the completed fabric in the form of upstanding pile-like loops.

Thus, the basic criteria for executing the method of the present invention so as to produce an elastic fabric in accordance with the present invention may be summarized as follows. One of three guide bars of the knitting machine is threaded with elastic yarns, one guide bar is threaded with ground yarns, and one guide bar is threaded with loop-forming yarns. The ground and loop-forming yarns should preferably be essentially inelastic, at least in comparison with the resiliently stretchable character of the elastic yarns. The ground yarns may be filamentary or spun yarns, and may be textured or non-textured, with synthetic filamentary textured yarns being preferred. The loop-forming yarns may similarly be filamentary or spun yarns, and either textured or non-textured, with synthetic filamentary untextured yarns being preferred. Each set of yarns should be threaded on spaced guide eyes of their respective guide bars. For example, the ground and elastic yarns may have the same threading pattern on corresponding spaced guide eyes of their respective guide bars, while the loop-forming yarns may be threaded oppositely to that of the ground and elastic yarns on guide eyes of the loop-forming yarn guide bar which correspond to empty guide eyes of the ground and elastic yarn guide bars. More specifically, each set of yarns may be threaded alternatingly on every other guide eye of its respective guide bar, e.g., with the ground and elastic yarns being threaded in a so-called "one-in, one-out" threading arrangement wherein every alternate guide eye is threaded and every intervening guide eye is empty, while the loop-forming yarns may be threaded oppositely in a so-called "one-out, one-in" threading pattern wherein every alternate guide eye is empty and every intervening guide eye is threaded with a loop-forming yarn.

The respective stitch patterns of the ground, elastic and loop-forming yarns must be selected to cooperate so as to always knit the ground and elastic yarns on the same spaced, preferably alternating, needles of the needle bar, while the stitch pattern executed by the loop-forming yarns must be selected to cause such yarns to knit only periodically on the same spaced needles as the ground and elastic yarns, e.g., only during the formation of alternating courses in the fabric structure, but otherwise to periodically form loops on inactive needles, e.g., during the knitting of intervening courses of the fabric.

Various stitch patterns within the scope of the aforementioned requirements are possible. The respective stitch patterns executed by the ground and elastic yarns are selected to determine the degree and direction of elasticity in the finished fabric. For example, the elastic yarns may be knitted in a chain stitch pattern, in conjunction with a coursewise traversing pattern of the ground yarns, to impart predominantly walewise elasticity to the finished fabric. Alternatively, both the elastic and ground yarns may be arranged to execute coursewise traversing stitch patterns so as to impart both walewise and coursewise elasticity to the finished fabric.

The loop-forming yarns may be formed about the inactive needles in either an open or closed loop configuration when forming the pile loops not integrated into the fabric ground structure, which enables variations to be created in the character of the pile loop surface of the fabric. Likewise, the stitch pattern followed by the loop-forming yarns can be such as to traverse in opposite directions between the stitches of the loop-forming yarns incorporated into the ground structure of the fabric so as to cast off the pile loops alternatingly in leftward and rightward directions between the stitches anchored in the ground structure so as to also enable selective variation in the character of the pile loop surface of the fabric.

Referring now to the accompanying drawings and initially to FIGS. 1 and 2, one particular embodiment of the present textile fabric is illustrated as preferably warp knitted of a three-bar construction on a three-bar warp knitting machine according to the present method. As is conventional, the needle bar of the warp knitting machine carries a series of aligned knitting needles, while each guide bar of the machine carries a series of guide eyes, the needle and guide bars typically having the same gauge, i.e., the same number of needles and guide eyes per inch. According to the illustrated embodiment of the present fabric, the bottom guide bar of the machine is threaded on alternating guide eyes with a set of ground yarns 10 delivered from a warp beam (not shown) in a so-called one-in, one-out, threading pattern (i.e., every alternate guide eye is threaded with a ground yarn 10, while every intervening guide eye is empty), while the middle guide bar is threaded in the same one-in, one-out, threading pattern on alternating guide eyes with a set of elastic yarns 12 delivered from another warp beam (also not shown). The top guide bar is threaded on alternating guide eyes with a set of loop-forming yarns 14 supplied from a third warp beam (also not shown), but the threading pattern of the top guide bar is reversed from that of the bottom and middle guide bars to be in a so-called one-out, one-in threading pattern (i.e., every intervening guide eye is threaded with a loop-forming yarn 14, while every alternate guide eye is empty). Thus, as more fully explained hereinafter, the threading arrangement of the three guide bars is set up in conjunction with the stitch patterns executed by the guide bars for the three sets of yarns to deliver the ground, elastic and loop-forming yarns 10, 12, 14 to correspondingly alternating and intervening needles of the needle bar to produce the fabric structure represented in FIGS. 1 and 2.

In this embodiment of FIGS. 1 and 2, the ground yarns are preferably textured multi-filament yarns, such as a 70 denier, 34 filament semi-dull textured polyester yarn comprised of filaments of round cross-section. The loop-forming yarns similarly are preferred to be synthetic multi-filament yarns, but are preferably non-textured (i.e. flat), such as a 40 denier, 8 filament semi-dull polyester comprised of filaments of round cross-section. The elastic yarns are preferably a monofilament spandex yarn, such as a 70 denier monofilament spandex yarn of a 40 percent elongation.

The stitch constructions of the ground, elastic and loop-forming yarns 10, 12, 14, as carried out by the respective lateral traversing movements of the guide bars of the knitting machine according to this embodiment of the present fabric and method, are illustrated individually in FIG. 1 in a traditional dot or point diagram format, wherein the individual points 15 represent the needles of the needle bar of the knitting machine in the formation of several successive fabric courses C across several successive fabric wales W. According to this embodiment, the bottom guide bar of the warp knitting machine manipulates the ground yarns 10 as they are fed from their respective warp beam to traverse laterally back and forth relative to the needle bar of the machine to stitch the ground yarns 10 on alternate needles 15A in a repeating 0-0, 5-0 inlay pattern, as indicated by Bar 1 of FIG. 1. Simultaneously, the middle guide bar of the knitting machine manipulates the set of elastic yarns 12 as they are fed from their respective warp beam to traverse relative to the needle bar to stitch the elastic yarns 12 on the same alternating needles 15A in a repeating 1-0, 0-1 chain stitch pattern, as indicated at Bar 2 in FIG. 1. The top guide bar simultaneously manipulates the set of loop-forming yarns 14 as they are fed from their respective warp beam to traverse relative to the needle bar alternately to stitch the loop-forming yarns 14 on the same alternating needles 15A and then to lay the yarns 14 without stitch formation about the intervening needles 15B in a repeating 4-3, 1-0 stitch pattern, as indicated at Bar 3 of FIG. 1. The respective simultaneous stitch patterns of the ground, elastic and loop-forming yarns 10, 12, and 14 are shown in a composite point diagram in FIG. 2.

As will thus be understood, because the intervening needles 15B are inactive throughout the entire knitting operation other than to temporarily hold loops of the loop-forming yarns 14 but cast off such loops without their integration into the ground structure, only the needles 15A contribute to the formation of wales W in the resultant knitted fabric. Thus, the ground and the loop-forming yarns 10, 12 are interknitted with one another into the ground structure of the fabric in every wale W of every course C, the stitch construction of the elastic yarns 12 forming each elastic yam 12 in one respective wale W in needle loops 12*n* appearing successively in every course C in walewise alignment to one another, owing to the chain stitch construction of the elastic yarns 12, and each ground yarn 10 being inlaid traversingly back-and-forth coursewise through the chain stitches 12*n* of three respective elastic yarns 12, owing to the inlaid pattern of the ground yarns 10. The stitch construction executed by the loop-forming yarns 14 form them in needle loops 14*n* appearing in every wale W of alternating courses C1, with each loop-forming yam 14 having its needle loops

14*n* aligned walewise with one another in a common respective wale W and with a non-knitted underlap extent 14*u* cast off from the inactive needles 15B extending in the form of upstanding pile loops between the successive needle loops 14*n* generally in the same common wale W across the intervening courses C2. As a result, the underlap extents 14*u* of the loop-forming yarns 14 are substantially elongated and are free to extend outwardly from the corresponding face of the fabric, i.e., the technical back thereof.

As will thus be understood, the ground fabric structure formed by the ground yarns 10, 12, provides coursewise dimensional stability and structural integrity to the fabric due to the coursewise inlaid pattern followed by the inelastic ground yarns 10, but the ground yarns 10 impose minimal restriction on the ability of the fabric structure to stretch in the walewise direction, whereby the fabric is enabled to elastically stretch resiliently in the walewise direction substantially to the full elongation range of the elastic yarns 12. The feeding of the loop-forming yarns 14 via the top guide bar of the knitting machine causes such yarns to appear predominantly at the technical back of the fabric, whereas the extended underlaps 14*u* project generally outwardly of the fabric surface in the nature of elongated pile loops. As a results, the underlap loops 14*u* produced by the present fabric construction make the fabric well suited for use as the loop component of a hook-and-loop fastener, the outwardly extending disposition of the underlap loops 14*u* orienting them optimally for engagement with the hook element of a mating fastener hook component, which could be of a variety of conventional constructions. Advantageously, the elongated nature of the underlap loops 14*u* provides sufficient loop elevation from the fabric surface that napping, brushing or other mechanical raising of the loops, which is conventionally necessary in other fastener loop fabric constructions, can be avoided altogether. Since the loop-forming yarns 14 are threaded on every intervening guide eye of the top guide bar and are knitted into every other course C1 of the fabric, the threading arrangement and stitch pattern executed by the loop-forming yarns 14 maximizes the density of the pile-like underlap loops 14*u* within the fabric structure.

With reference now to FIGS. 3 and 4, an alternative embodiment of the present fastener fabric, and the method of producing the fabric, is illustrated similarly to FIGS. 1 and 2 in stitch diagrams showing the constituent yarns of the fabric individually and as they appear in combination in the finished fabric. The embodiment of FIGS. 3 and 4 is comparable to that of FIGS. 1 and 2 in that this fabric likewise is elastically stretchable predominantly in the walewise direction. The constituent ground, elastic and loop-forming yarns are indicated in FIGS. 3 and 4 by reference numerals 110, 112, 114, but the types, sizes, and threading patterns of such yarns on their respective guide bars are identical to that of the embodiment of FIGS. 1 and 2. Likewise, the stitch patterns executed by the elastic yarns 112, and the loop-forming yarns 114 are identical to that of the embodiment of FIGS. 1 and 2. The principal essential difference in the embodiment of FIGS. 3 and 4 from that of FIGS. 1 and 2 is that the ground yarns 10 are not inlaid in the fabric structure but rather are knitted in a 1-0, 4-5 stitch pattern. As a result, the ground yarns 110 are formed in needle loops 110*n* in every wale of every course. However, owing to the elongated coursewise traversing of the stitch pattern of each ground yarn 110 across five needles on the warp knitting machine (and, in turn, across three wales in the completed fabric), the ground yarns 110 still permit the chain stitched elastic yarns 112 to stretch in the walewise direction, albeit to a more limited extent than the fabric of FIGS. 1 and 2.

FIGS. 5 and 6 depict a third embodiment of the fabric and method of the present invention, wherein the fabric is elastic in both walewise and coursewise directions. In this embodiment, the ground, elastic and loop-forming yarns are designated by reference numerals 210, 212, 214. The ground, elastic and loop-forming yarns 210, 212, 214 are substantially identical in type and size to that of the embodiments of FIGS. 1 and 2 and FIGS. 3 and 4, but the threading arrangement and stitch patterns of the yarns are considerably different. Specifically, in this embodiment, the elastic yarns 212 are threaded on the bottom guide bar, represented by Bar 1 in FIG. 5, rather than on the middle guide bar, while the ground yarns 210 are threaded on the middle guide bar (Bar 2). The threading arrangement of the elastic and ground yarns otherwise is the same as the embodiments of FIGS. 1 and 2 and FIGS. 3 and 4, that is, the elastic yarns 212 are threaded "one in, one-out" on the bottom guide bar, while the ground yarns 210 are threaded "one-in, one-out" on the middle guide bar. The loop-forming yarns 114 are threaded oppositely, "one-out, one-in" on the top guide bar (Bar 3). The elastic yarns 212 are knitted in a 1-0, 2-3 coursewise traversing stitch pattern, while the ground yarns 210 are knitted in opposition to the elastic yarns 212 but in a similarly coursewise traversing 4-5, 1-0 stitch pattern. As in the embodiments of FIGS. 1 and 2 and FIGS. 3 and 4, the loop-forming yarns 214 are knitted in opposition to the ground yarns 210 in a 1-0, 4-3 stitch pattern.

As those persons skilled in the art will recognize and understand, the combination of stitch patterns executed by the ground, elastic and loop-forming yarns 210, 212, 214 permits the elastic yarns 212 to stretch comparably in both walewise and coursewise directions, so as to impart multi-directional elasticity to the fabric, but the stitch pattern of the ground yarns 210 acts to limit the available degree of stretchability of the elastic yarns in both coursewise and walewise directions, whereby this embodiment of the present invention has a greater degree of dimensional stability and structural integrity than the embodiments of FIGS. 1 and 2 and FIGS. 3 and 4.

As will be understood by persons skilled in the art, the fabric of the present invention provides several distinct advantages over conventional loop-type textile fastener fabric constructions. Most fundamentally, the present invention uniquely enables the raised pile loops of the fabric to be produced by the knitting machine as part of the knitting process, whereby the stretchable fabric of the present invention does not require any subsequent napping, brushing or other further processing steps to be performed to render the fabric suitable for use in a two-component hook-and-loop fastener. As a results, the manufacturing cost of the present fabric can be relatively reduced in comparison to conventional stretchable loop-type fastener fabrics, while providing a superior stretchable fabric with more a consistent loop surface than conventional napped or brushed fabrics. By the appropriate selection of the stitch pattern executed by the elastic yarns and the ground yarns and by the selective choice of the type and denier of such yarns, the stretchable character of the fabric can be selectively engineered to provide one-directional (walewise, typically) stretchability or multi-directional (walewise and coursewise) stretchability and to control the degree of available stretchability as well. Similarly, by the selection of the type, size and stitch pattern of the loop-forming yarns, the character of the loop surface of the fabric, e.g., the density, spacing, height, shape, inclination, etc., of the upstanding pile loops, can also be selectively determined and varied.

Thus, it is to be recognized and understood by persons skilled in the art that the particular yarns and yarn sizes as well as the particular stitch patterns executed by the constituent yarns of this invention, may be selectively varied as desired, within the parameters described above, to modify the properties and characteristics of the resultant fabric so as to achieve differing embodiments of the fabric suited to differing uses, so long as the fabric construction utilizes at least one set of elastic yarns in a stitch construction lending elasticity of the resultant fabric and the loop-forming yarns are knitted in a stitch pattern selected to achieve elongated underlaps which are not anchored into the fabric structure so as to permit the underlaps to extend outwardly from the fabric in the nature of pile loops. Likewise, it is contemplated that the fastener loop fabric of the present invention could be of a four-bar construction rather than a three-bar construction, if desirable to achieve additional or different fabric properties. These and any and all other such modifications and variations on the present invention are intended to be within the scope of the present invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A warp knitted textile fabric characterized by a resiliently stretchable three-bar stitch construction having one fabric surface which presents outwardly extending knitted loops adapted for mated engagement with hooking elements of another fabric for use in a two-component fabric fastener of the hook-and-loop type, the fabric comprising a set of ground yarns, a set of elastic yarns and a set of loop-forming yarns interknitted together in respective patterns of stitches formed in longitudinally extending wales and transversely extending courses wherein the elastic yarns are knitted in a chain stitch pattern, the ground yarns provide structural integrity to the fabric while permitting the elastic yarns to stretch and contract in at least one fabric direction and the loop-forming yarns form stitches interknitted with the ground and elastic yarns in only selected spaced courses and form the outwardly extending knitted loops therebetween.

2. A warp knitted textile fabric according to claim 1, wherein the ground and elastic yarns form stitches in substantially each wale of substantially each course of the fabric.

3. A warp knitted textile fabric according to claim 1, wherein the loop-forming yarns form stitches in alternate courses of the fabric.

4. A warp knitted textile fabric according to claim 1, wherein the respective stitch patterns of the ground, elastic and loop-forming yarns permit resilient stretchability of the fabric in the walewise direction.

5. A warp knitted textile fabric according to claim 1, wherein the ground yarns are formed in a coursewise inlaid stitch pattern.

6. A warp knitted textile fabric according to claim 1, wherein the ground yarns are knitted in a stitch pattern wherein stitches of each ground yarn traverse coursewise between spaced wales.

7. A warp knitted textile fabric according to claim 6, wherein the stitches of the ground yarns traverse multiple wales.

8. A warp knitted textile fabric according to claim 1, wherein the ground yarns are inelastic.

9. A warp knitted textile fabric according to claim 8, wherein the ground yarns are textured synthetic filamentary yarns.

10. A warp knitted textile fabric according to claim 1, wherein the loop forming yarns are inelastic.

11. A warp knitted textile fabric according to claim 10, wherein the loop forming yarns are untextured filamentary yarns.

12. A warp knitted textile fabric according to claim 1, wherein the ground yarns are inlaid in a 0-0, 5-0 pattern, the elastic yarns are knitted in a 1-0, 0-1 chain stitch pattern, and the loop forming yarns are knitted in a 4-3, 1-0 stitch pattern.

13. A warp knitted textile fabric according to claim 1, wherein the ground yarns are knitted in a 1-0, 4-5 pattern, the elastic yarns are knitted in a 1-0, 0-1 chain Stitch pattern, and the loop forming yarns are knitted in a 4-3, 1-0 stitch pattern.

14. A warp knitted textile fabric characterized by a resiliently stretchable three-bar stitch construction having one fabric surface which presents outwardly extending knitted loops adapted for mated engagement with hooking elements of another fabric for use in a two-component fabric fastener of the hook-and-loop type, the fabric comprising a set of ground yarns, a set of elastic yarns and a set of loop-forming yarns interknitted together in respective patterns of stitches formed in longitudinally extending wales and transversely extending courses wherein the ground yarns provide structural integrity to the fabric while permitting the elastic yarns to stretch and contract in at least one fabric direction and the loop-forming yarns form stitches interknitted with the ground and elastic yarns in only selected spaced courses and form the outwardly extending knitted loops therebetween, wherein the ground yarns are knitted in a 4-5, 1-0 pattern, the elastic yarns are knitted in a 1-0, 2-3 stitch pattern, and the loop forming yarns are knitted in a 1-0, 4-3 stitch pattern.

15. A method of producing a warp knitted textile fabric characterized by a resiliently stretchable three-bar stitch construction having one fabric surface which presents outwardly extending knitted loops adapted for mated engagement with hooking elements of another fabric for use in a two-component fabric fastener of the hook-and-loop type, the method comprising the steps of:

(a) providing a warp knitting machine having a needle bar equipped with a series of aligned knitting needles, (b) interknitting a set of ground yarns, a set of elastic yarns, and a set of loop-forming yarns in respective patterns of stitches formed in longitudinally extending wales and traversely extending courses wherein (i) the elastic yarns are knitted in a chain stitch pattern, (ii) spaced courses of the fabric are formed by knitting stitches of the ground, elastic and loop-forming yarns together on spaced needles of the needle bar, and (iii) intervening courses of the fabric are formed by knitting stitches of the ground and elastic yarns on the spaced needles, forming loops of the loop-forming yarns on intervening needles of the needle bar and then casting-off from the intervening needles the loops in the loop forming yarns, (iv) the ground and elastic yarns being knitted in stitches in substantially each wale of substantially each course of the fabric to provide structural integrity to the fabric while permitting the elastic yarns to stretch in at least one fabric direction, and (v) the loop-forming yarns being knitted with the ground and elastic yarns in stitches in spaced courses to secure the loop-forming yarns in the fabric with the cast-off loops of the loop-forming yarns extending therebetween outwardly from the fabric.

16. A method of producing a warp knitted textile fabric according to claim 15, wherein the loop-forming yarns form stitches in alternate courses of the fabric.

17. A method of producing a warp knitted textile fabric according to claim 15, wherein the respective stitch patterns of the ground, elastic and loop-forming yarns permit resilient stretchability of the fabric in the walewise direction.

18. A method of producing a warp knitted textile fabric according to claim 15, wherein the ground yarns are formed in a coursewise inlaid stitch pattern.

19. A method of producing a warp knitted textile fabric according to claim 15, wherein the ground yarns are knitted in a stitch pattern wherein stitches of each ground yarn traverse coursewise between spaced wales.

20. A method of producing a warp knitted textile fabric according to claim 15, wherein the stitches of the ground yarns traverse multiple wales.

21. A method of producing a warp knitted textile fabric according to claim 15, wherein the ground yarns are inelastic.

22. A method of producing a warp knitted textile fabric according to claim 15, wherein the ground yarns are textured synthetic filamentary yarns.

23. A method of producing a warp knitted textile fabric according to claim 15, wherein the loop-forming yarns are inelastic.

24. A method of producing a warp knitted textile fabric according to claim 15, wherein the loop forming yarns are untextured filamentary yarns.

25. A method of producing a warp knitted textile fabric according to claim 15, wherein the ground yarns are inlaid in a 0-0, 5-0 pattern, the elastic yarns are knitted in a 1-0, 0-1 chain stitch pattern, and the loop forming yarns are knitted in a 4-3, 1-0 stitch pattern.

26. A method of producing a warp knitted textile fabric according to claim 15, wherein the ground yarns are knitted in a 1-0, 4-5 pattern, the elastic yarns are knitted in a 1-0, 0-1 chain stitch pattern, and the loop forming yarns are knitted in a 4-3, 1-0 stitch pattern.

27. A method of producing a warp knitted textile fabric characterized by a resiliently stretchable three-bar stitch construction having one fabric surface which presents outwardly extending knitted loops adapted for mated engagement with hooking elements of another fabric for use in a two-component fabric fastener of the hook-and-loop type, the method comprising the steps of:

(a) providing a warp knitting machine having a needle bar equipped with a series of aligned knitting needles, (b) interknitting a set of ground yarns, a set of elastic yarns, and a set of loop-forming yarns in respective patterns of stitches formed in longitudinally extending wales and traversely extending courses, wherein the ground yarns are knitted in a 4-5, 1-0 pattern, the elastic yarns are knitted in a 1-0, 2-3 stitch pattern, and the loop forming yarns are knitted in a 1-0, 4-3 stitch pattern such that (i) spaced courses of the fabric are formed by knitting stitches of the ground, elastic and loop-forming yarns together on spaced needles of the needle bar, and (ii) intervening courses of the fabric are formed by knitting stitches of the ground and elastic yarns on the spaced needles, forming loops of the loop-forning yarns on intervening needles of the needle bar and then casting-off from the intervening needles the loops in the loop forming yarns, (iii) the ground and elastic yarns being knitted in stitches in substantially each wale of substantially each course of the fabric to provide structural integrity to the fabric while permitting the elastic yarns to stretch in at least one fabric direction, and (iv) the loop-forming yarns being knitted with the ground and elastic yarns in stitches in spaced courses to secure the loop-forming yarns in the fabric with the cast-off loops of the loop-forming yarns extending therebetween outwardly from the fabric.

* * * * *

UNITED STATES PATENT AND TRADEMARK OFFICE

CERTIFICATE OF CORRECTION

PATENT NO. : 6,845,639 B1
DATED : January 25, 2005
INVENTOR(S) : Peter Hajek

It is certified that error appears in the above-identified patent and that said Letters Patent is hereby corrected as shown below:

Column 6,
Line 31, change "0-0, 5-0" to -- 0-0, 5-5 --.
Line 67, change "yam" to -- yarn --.

Column 10,
Line 21, change "0-0, 5-0" to -- 0-0, 5-5 --.
Line 26, change the upper case of the word "Stitch" to lower case -- stitch --.

Column 11,
Line 46, change "0-0, 5-0" to -- 0-0, 5-5 --.

Signed and Sealed this

Fourteenth Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,845,639 B1
DATED : January 25, 2005
INVENTOR(S) : Peter Hajek

It is certified that error appears in the above-identified patent and that said Letters Patent is hereby corrected as shown below:

Title page,
Item [*] Notice, change "0 days" to -- 319 days --

Signed and Sealed this

Nineteenth Day of July, 2005

JON W. DUDAS
*Director of the United States Patent and Trademark Office*